US005430965A

United States Patent [19]

Lai

[11] Patent Number: 5,430,965

[45] Date of Patent: Jul. 11, 1995

[54] MESSAGE DISPLAY BOARD

[76] Inventor: Shih-Wang Lai, P.O. Box 55-1670, Taipei, Taiwan

[21] Appl. No.: 27,445

[22] Filed: Mar. 8, 1993

[51] Int. Cl.[6] ..... G09F 7/18

[52] U.S. Cl. ..... 40/597; 40/593; 40/358; 434/415; 434/417

[58] Field of Search ..... 40/593, 597, 591, 152.2, 40/358; 434/415, 417

[56] References Cited

U.S. PATENT DOCUMENTS

| | | | |
|---|---|---|---|
| 2,089,596 | 8/1937 | Buhr | 40/593 |
| 3,004,359 | 10/1961 | Pisciotta | 40/152.2 |
| 4,754,565 | 7/1988 | Cox | 40/591 |
| 4,955,153 | 9/1990 | Albrecht et al. | 40/593 |
| 5,099,594 | 3/1992 | Reas et al. | 40/593 X |
| 5,263,866 | 11/1993 | Campbell | 434/415 |

*Primary Examiner*—Edward K. Look
*Assistant Examiner*—Michael S. Lee

[57] ABSTRACT

A message display board includes: a writing board embedded on a base plate mounted on a fixing object such as a car, a pen clamped on a pen-holding portion formed on the base plate for writing purpose, a plurality of suction cups which are attached by vacuum on a wall such as a wind shield of a car to present the writing board outwardly to display message written on the writing board, a lamp secured on the base plate for illuminating the writing board to be visible at night time or in dark place, and an eraser detachably embedded in the base plate and being withdrawn from the base plate for erasing the message written on the board to prepare for the next use.

8 Claims, 9 Drawing Sheets

MESSAGE DISPLAY BOARD

BACKGROUND OF THE INVENTION

When temporarily parking a car C1 in a crowded city as shown in FIG. 17 outside those cars C previously parked on the road side, it is necessary to give a warning to the other by writing a message such as saying "sorry" or leaving the owner's phone number on a temporary paper which is then adhered on a car window.

However, such a temporary message or reminder sheet may have the following drawbacks:

1. A temporary paper sheet for writing message may be easily missing and lose its warning or message.

2. No illumination is provided for lighting such a temporary paper sheet thereby inhibiting the message at dark or night time.

3. The paper sheet can be used only for a single time and can not be repeatedly used. To dispose a used paper sheet may cause environmental pollution.

The present inventor has found the drawbacks of such a conventional temporary message sheet, and invented the present message board.

SUMMARY OF THE INVENTION

The object of the present invention is to provide a message display board including: a writing board embedded on a base plate mounted on a fixing object such as a car, a pen clamped on a pen-holding portion formed on the base plate for writing, a plurality of suction cups which are sucked by vacuum on a wall such as a wind shield of a car to present the writing board outwardly to display a message written on the writing board, a lamp formed on the base plate for illuminating the writing board to be visible at night time or in dark place, and an eraser detachably embedded in the base plate and being able to be withdrawn from the base plate for erasing the message written on the board to prepare for the next use.

DETAILED DESCRIPTION

Figure 1:
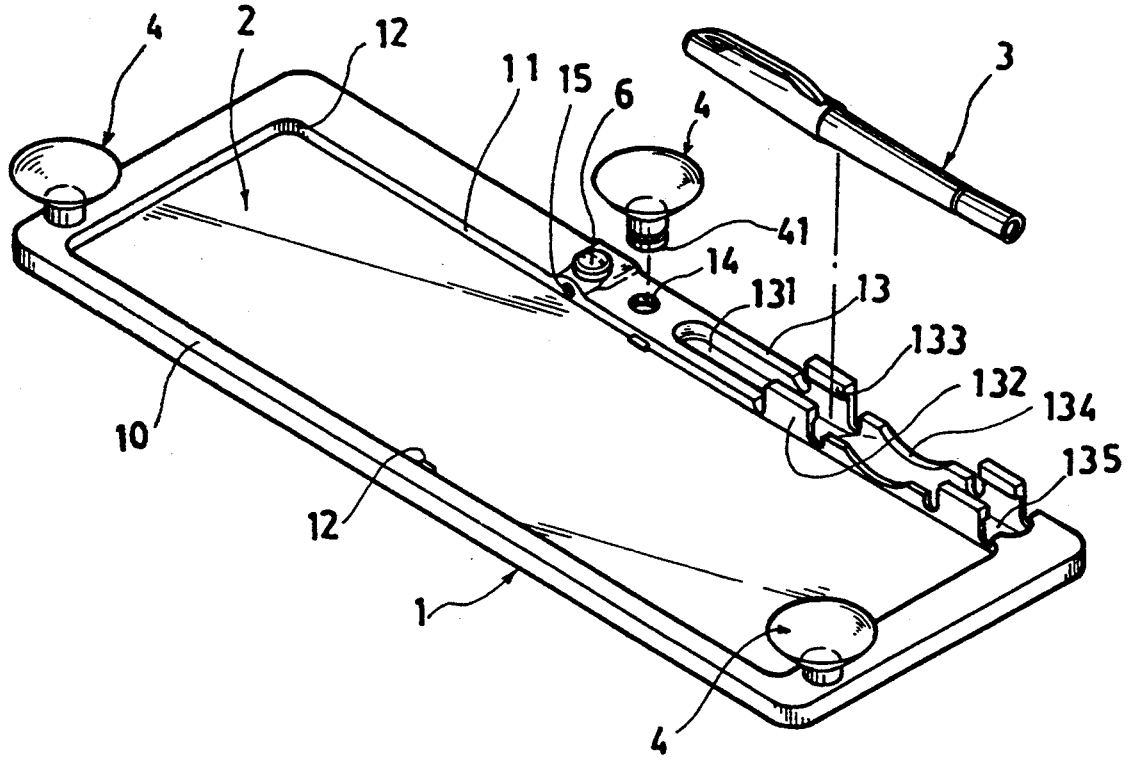
FIG. 1 is a perspective view showing a message display board of the present invention.
Figure 4:
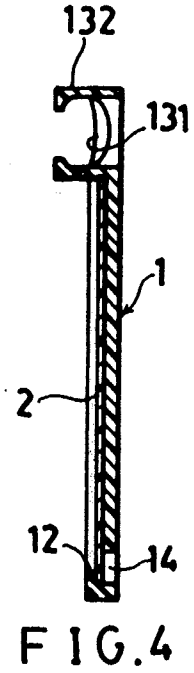
FIG. 4 is a side view sectional drawing of the message display board when viewed from 4—4 direction of FIG. 2.
Figure 2:
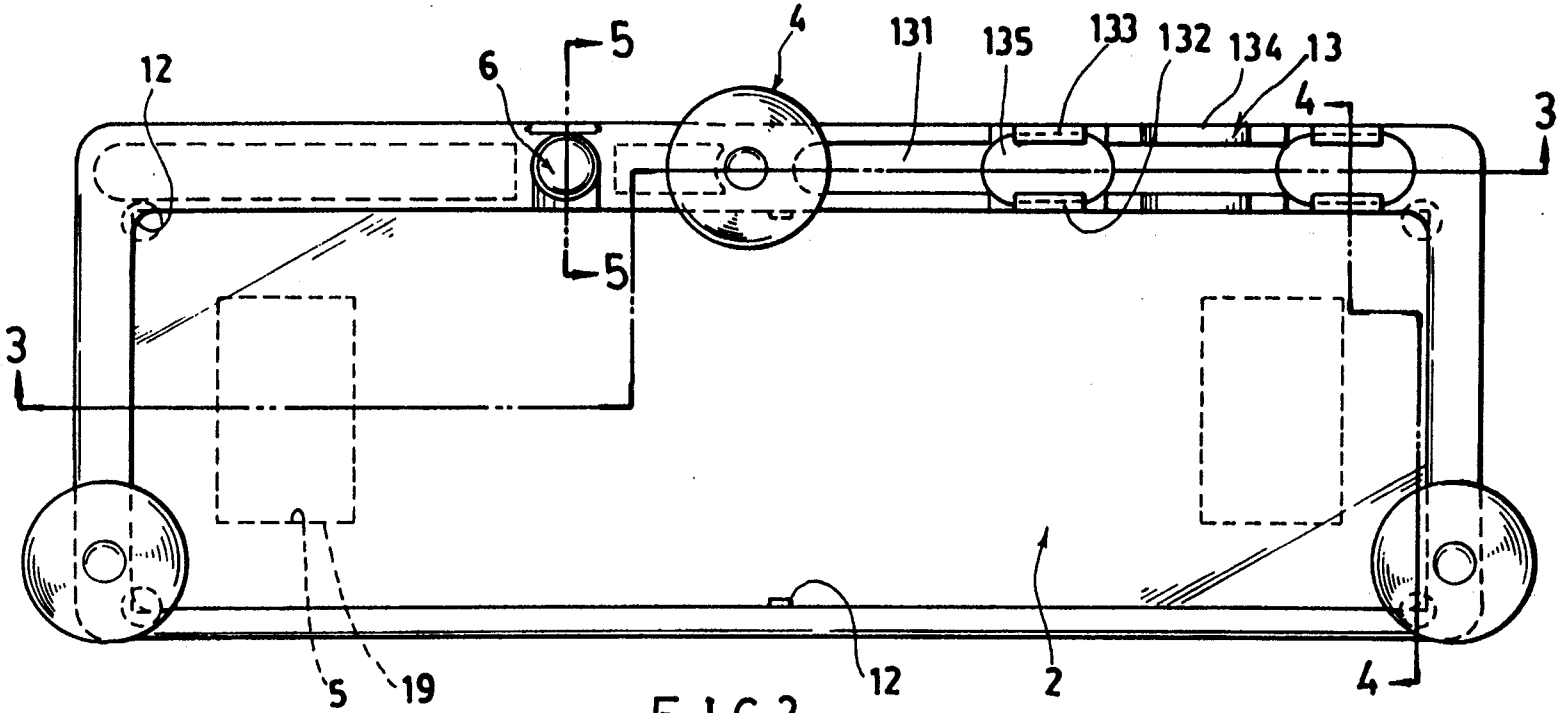
FIG. 2 is a top view illustration of the message display board of the present invention.
Figure 3:
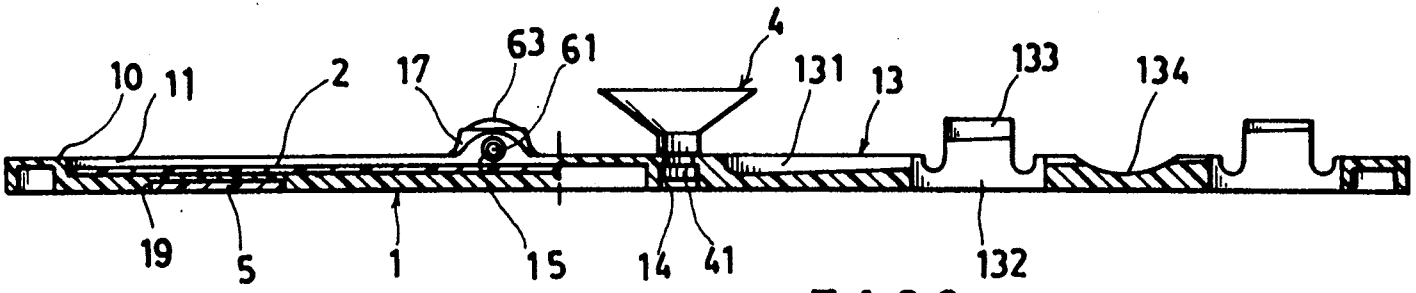
FIG. 3 is a front view sectional drawing of the message display board when viewed from 3—3 direction of FIG. 2.
Figure 5:
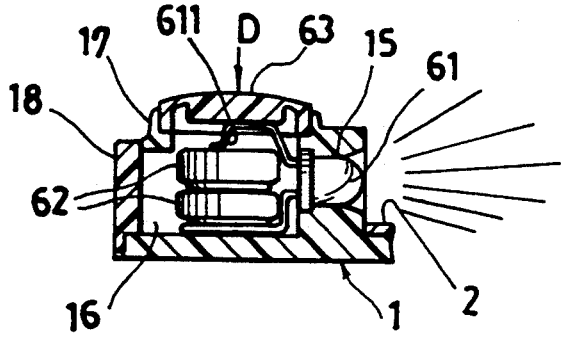
FIG. 5 is a side view partial sectional drawing of the message display board when viewed from 5—5 direction of FIG. 2.
Figure 6:
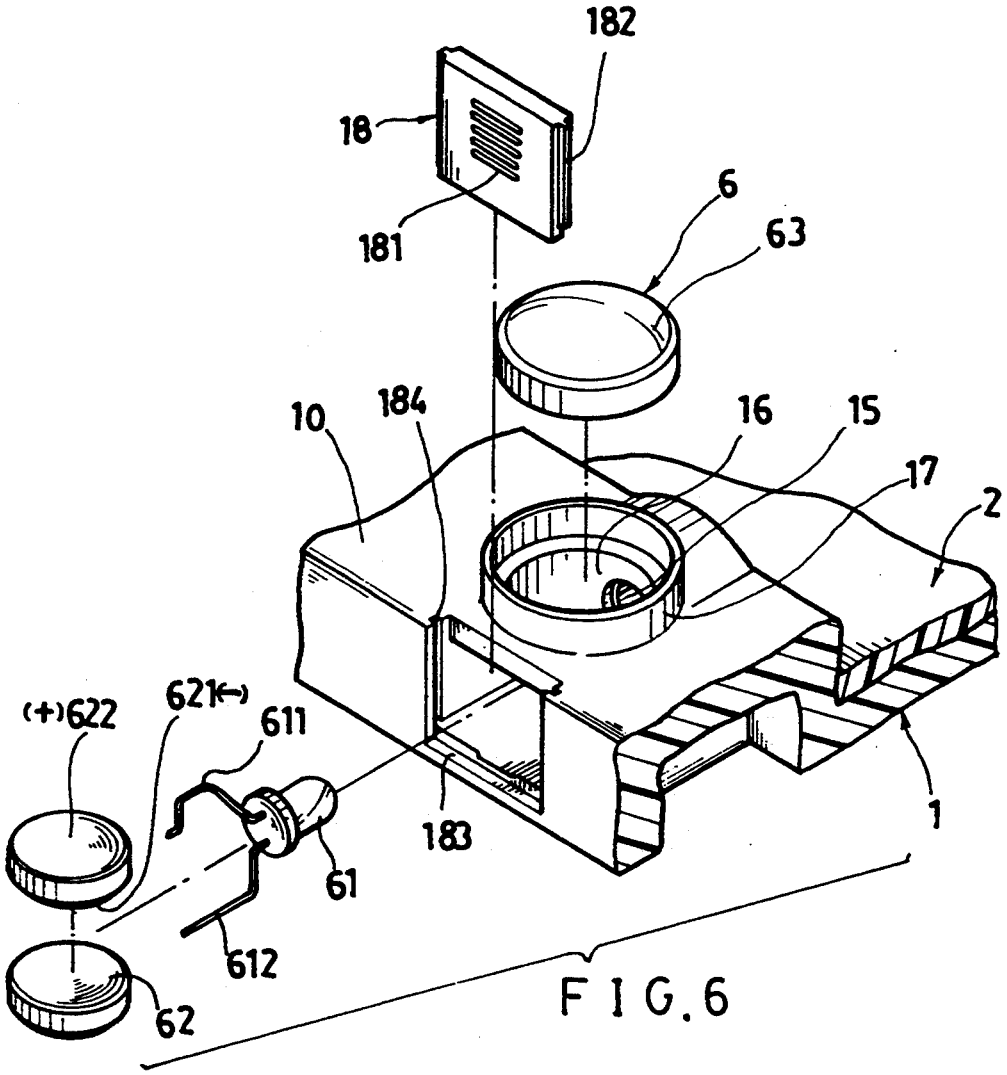
FIG. 6 is a perspective view of an illuminating means of the present invention.
Figure 7:
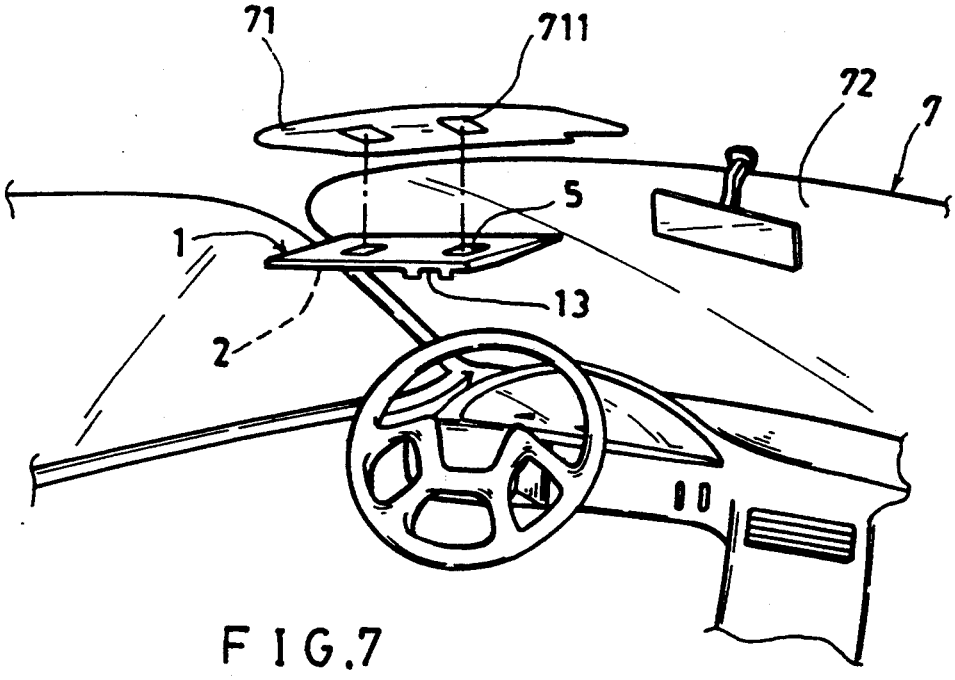
FIG. 7 is an illustration showing mounting of the present invention on a car visor.
Figure 8:
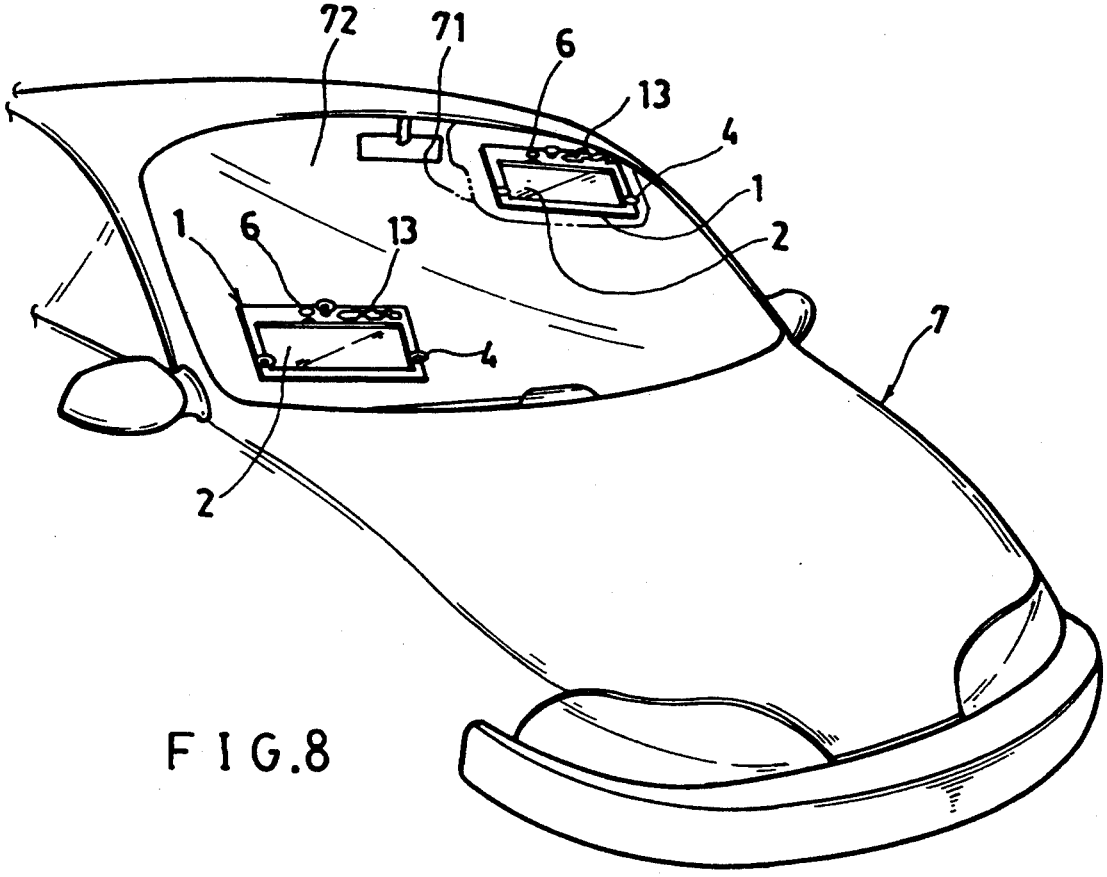
FIG. 8 shows another display method in accordance with the present invention.
Figure 9:
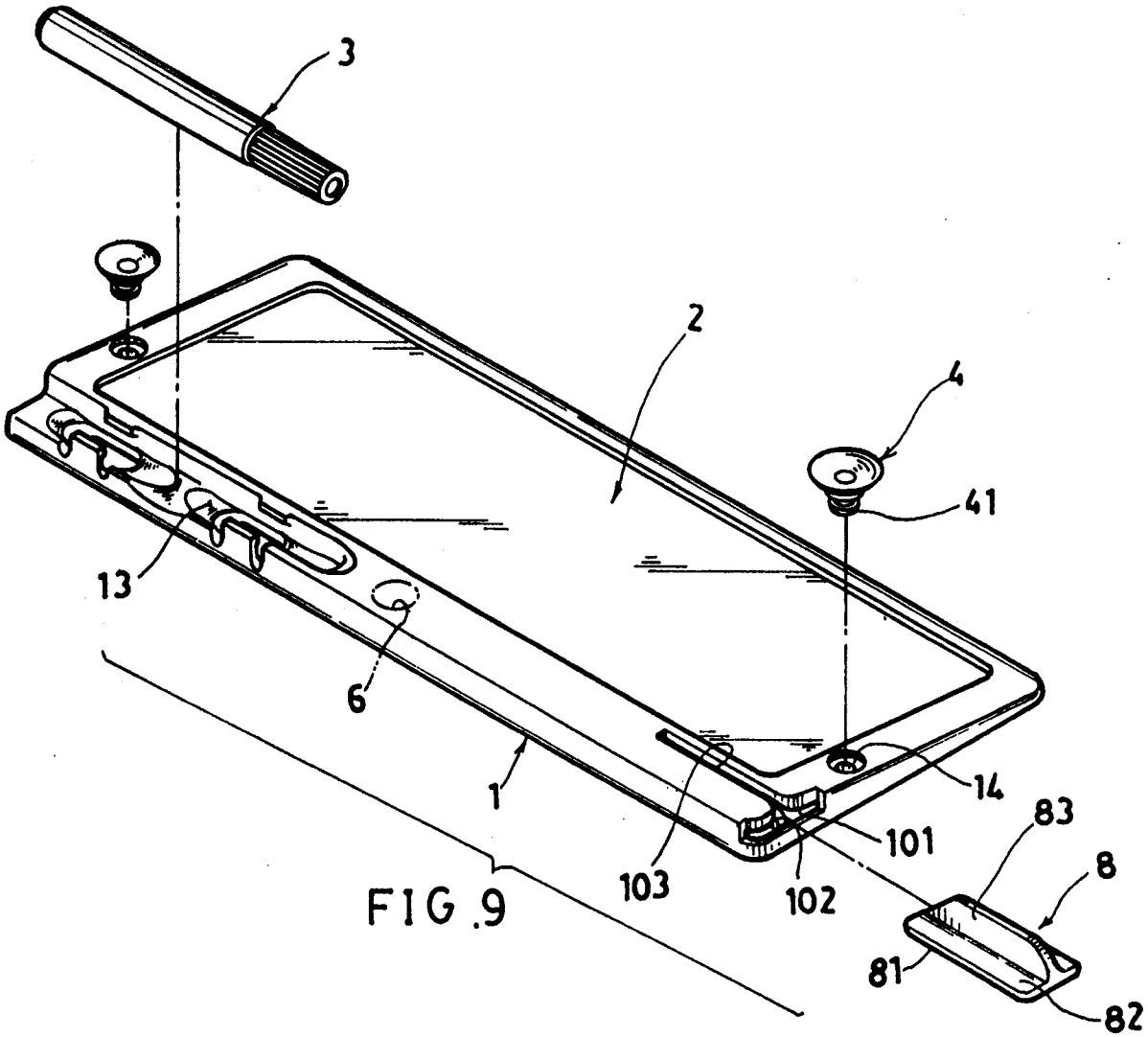
FIG. 9 is a perspective view of another preferred embodiment of the present invention.

As shown in FIGS. 1–8, a message display board of the present invention comprises: a base plate 1, a writing board 2, a pen 3, a plurality of front fastening members 4, a plurality of rear fastening members 5, and an illuminating means 6. The message display board of the present invention may be mounted on a car visor 71 as shown in FIGS. 7, 8 or on a windshield 72 of a car 7 as shown in FIG. 8. The shapes of the message display board are not limited in the present invention, and may be generally rectangular shaped.

The base plate 1 includes: a shallow socket 11 recessed in a central portion of the base plate 1 for embedding the writing board 2 in the shallow socket 11, a rim extension 10 circumferentially formed on a rim portion of the base plate 1 to confine the shallow socket 11 within the rim extension 10, a plurality of stoppers 12 formed along the rim extension 10 for holding the writing board 2 in the shallow socket 11, a pen-holding portion 13 formed on the rim extension 10 for clamping a writing pen 3 selected from a marking pen, a piece of chalk, or any other pens having removable or erasable ink filled in a pen barrel in the pen 3 for convenient repeated writing and erasing purposes, and a plurality of cup sockets 14 recessed in the rim extension 10 of the base plate 1.

The pen-holding portion 13 formed on the base plate 1 includes: a groove 131 longitudinally recessed in the rim extension 10 for snugly receiving a pen 3 in the groove 131, a plurality of pairs of pen clips 132 protruding upwardly or outwardly from the base plate 1 for clamping the pen 3 thereon each pen clip 132 having a pair of bending portions 133 bent inwardly for clamping the pen 3 in the clips 132, a pair of finger recesses 134 arcuately formed on the base plate 1 contiguous to the groove 131 for an easy take-away of the pen 3 by a user's fingers from the pen-holding portion 13 for writing message, and a plurality of mold-releasing holes 135 each hole 135 generally elliptical shaped formed through the base plate 1 for easily releasing a molding product of the base plate 1 of the present invention from an injection mold during a plastic molding process.

A plurality of back sockets 19 are recessed in a back portion of the base plate 1 each back socket 19 engageably embedded with a rear fastening member 5. Each rear fastening member 5 may be fixed on a fastener holding base 711 and the holding base 711 may be formed on a car visor 71 as shown in FIG. 7 so that the message display board can be secured to a car visor for a reusable display in a car 7.

The rear fastening member 5 may be a Velcro tape attached to the back socket 19 in the base plate 1.

The front fastening member 4 may be a suction cup each cup having a bolt portion 41 engageably embedded in a fastener socket 14 recessed in a rim extension 10 circumferentially formed on the base plate 1 having the writing board 2 embedded in the base plate 1. The suction cup 4 may be attached on a wall such as a wind shield 72 of a car 7 by vacuum as shown in FIG. 8.

The illuminating means 6 includes: a lamp 61 (or any other illuminators) having a first-pole wire 611 and a second-pole wire 612 respectively electrically connected to a first pole 621 and a second pole 622 of a power source which may be a battery 62, and an on-off switch 63 resiliently formed on the base plate 1 to be depressed for switching on (D) the power source 62 of the illuminating means 6 for lighting the lamp 61 for illuminating the writing board 2 or to be actuated for switching off the lamp 61 when not in use.

The on-off switch 63 of the illuminating means 6 may be a flip-flop switch made of elastomer or silicon rubber which can be first depressed to contact the two poles of the power source 62 for lighting the lamp 61, and upon a further depression on the switch 63, the two poles of the power source will be disconnected for switching off the lamp 61.

The lamp 61 of the illuminating means 6 is protruded sidewardly towards the writing board 2 embedded in the base plate 1 through a lamp hole 15 formed in a rim extension 10 circumferentially disposed around the base plate 1. The lamp hole 15 is transversely communicating with a battery chamber 16 which is recessed in the rim extension 10 for storing the battery of the power source 62 in the battery chamber 16. The battery chamber 16 is vertically connected with a bush 17 which is protruded upwardly or outwardly for holding the on-off switch 63 of the illuminating means 6 in the bush 17. A maintenance door 18 is detachably secured on a side portion of the rim extension 10 for shielding the battery chamber 16.

The maintenance door 18 includes a plurality of ventilation openings 181 formed through the door 18 for outwardly dissipating heat as emitted from the lamp 61, a pair of tenons 182 formed on two opposite side portions of the door and slidably engageable with a pair of cavities 184 juxtapositionally longitudinally recessed in a door frame 183 formed on the rim extension 10 for slidably engaging the tenons 182 of the maintenance door 18 for allowing the door 18 for shielding the battery chamber 16. The door 18 may be opened for replacing new batteries 62 from the chamber 16.

As shown in FIGS. 9–14, the present invention may further comprise an eraser 8 detachably inserted in an eraser socket 101 formed in the base plate 1.

The eraser 8 includes: an erasing pad 81 secured on a bottom portion of an eraser base 82, a handle 83 protruding upwardly from the eraser base 82, with the erasing pad 81 and the eraser base 82 slidably engageable in the eraser socket 101 recessed in the base plate 1 and resiliently retained in the eraser socket 101 as urged by a spring member 102 resiliently formed in the eraser socket 101, and a handle slot 103 formed in the base plate 1 and communicating with the eraser socket 101 and having a width of the slot 103 smaller than a width of the eraser socket 101, the handle slot 103 slidably engageable with the handle 83 of the eraser 8 so that the eraser 8 may be withdrawn from the eraser socket 101 for erasing the message written on the board 2 or may be re-inserted into the eraser socket 101 for storing the eraser 8 in the socket 101.

Figures 10, 11, 12, 13:
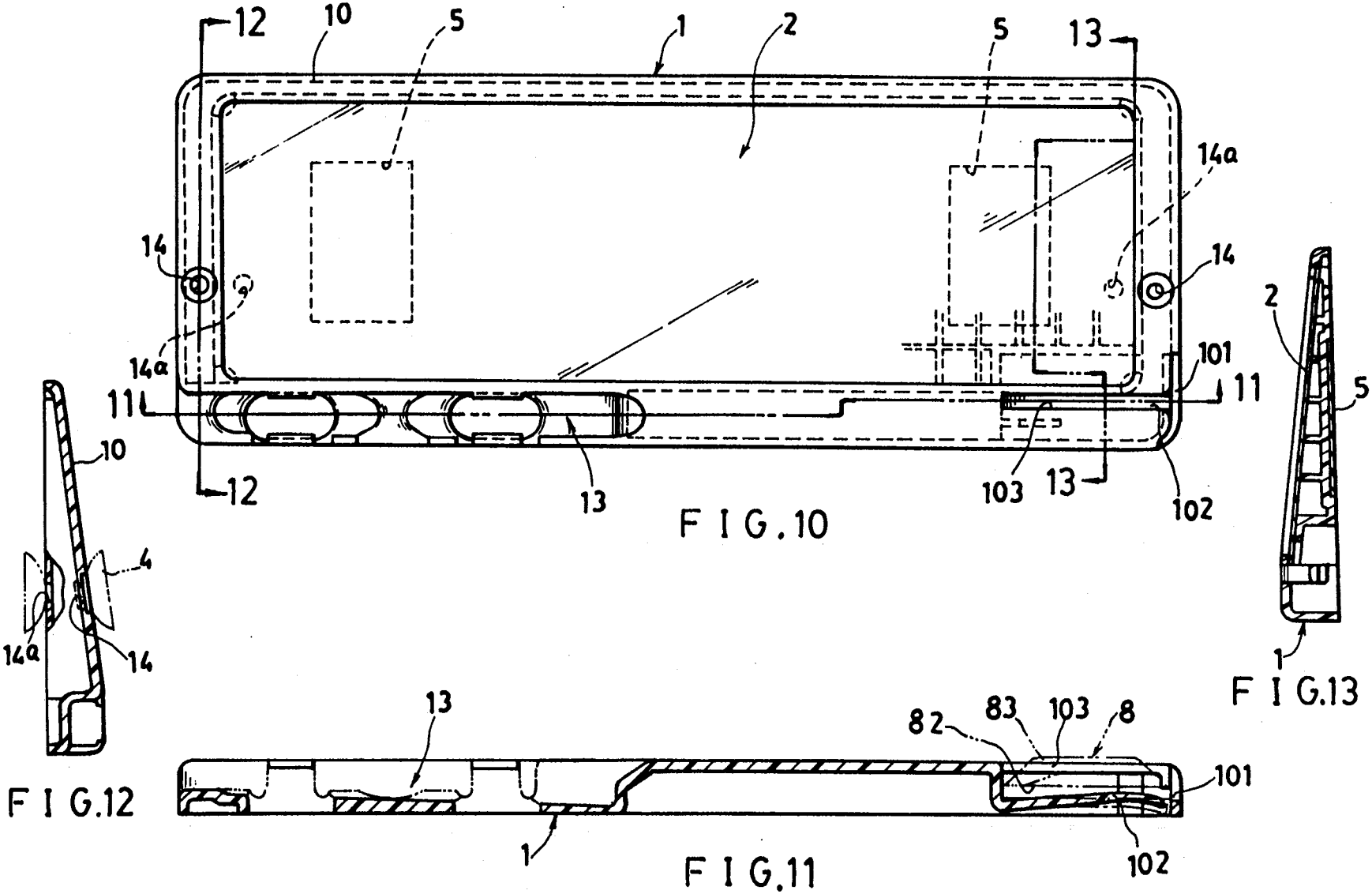
FIG. 10 is a top view of the message display board as shown in FIG. 9.
FIG. 11 is a front view sectional drawing of the message display board when viewed from 11—11 direction of FIG. 10.
FIG. 12 is a side view sectional drawing of the message display board when viewed from 12—12 direction of FIG. 10.
FIG. 13 is a side view sectional drawing of the message display board when viewed from 13—13 direction of FIG. 10.
Figure 14:
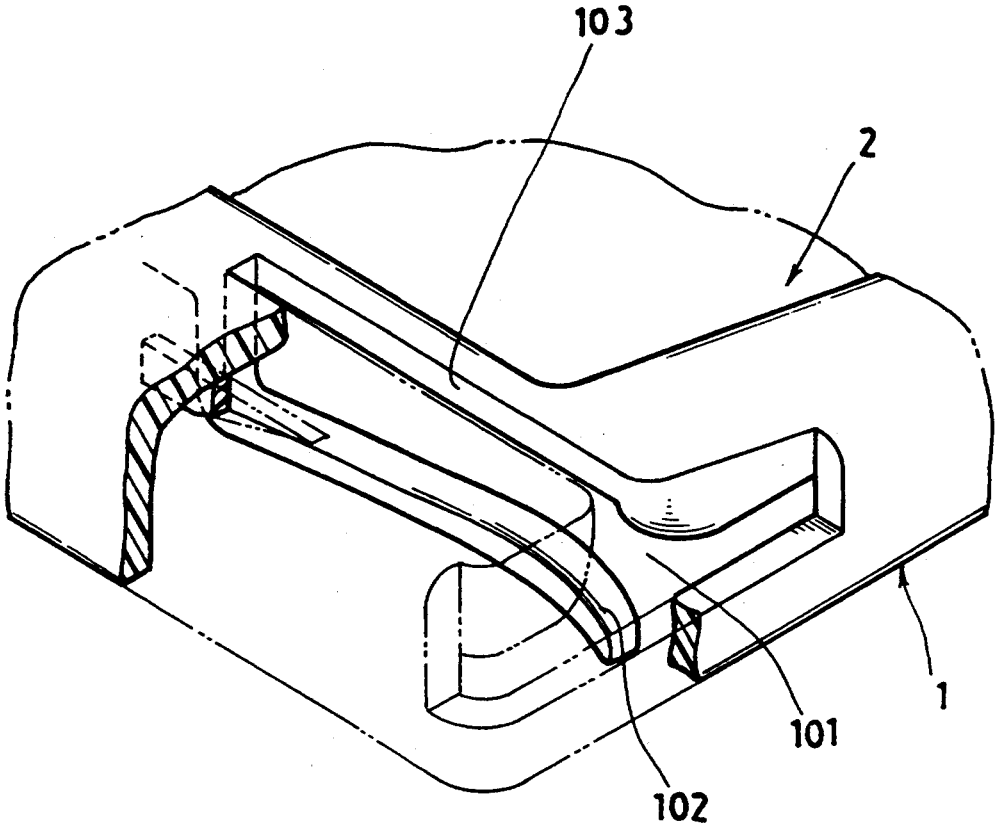
FIG. 14 shows an eraser socket of the present invention.
Figure 15:
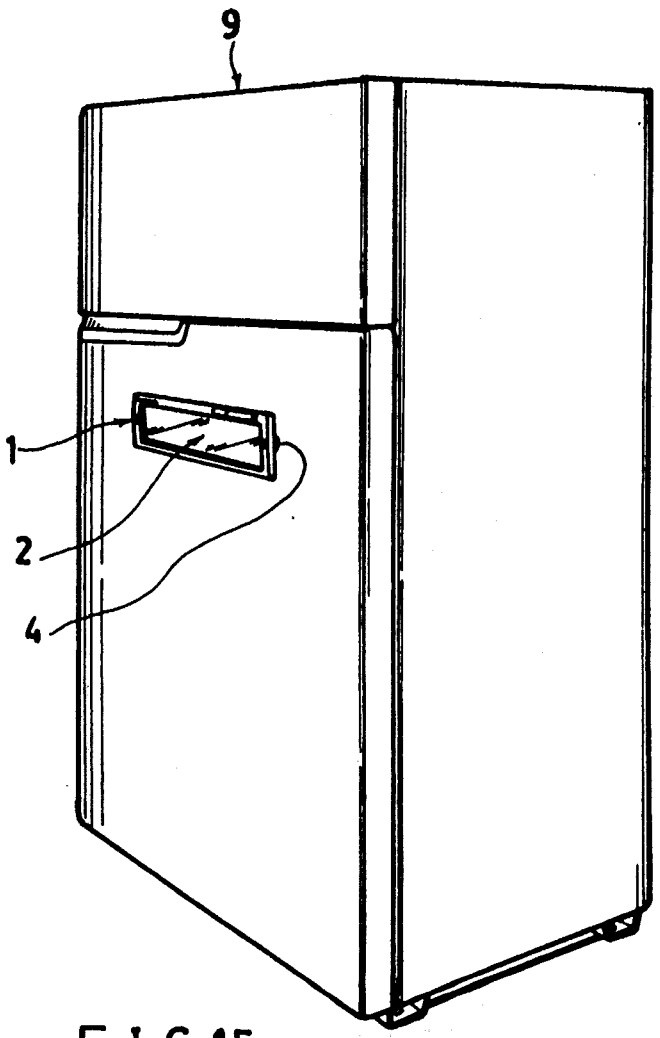
FIG. 15 shows a message display board of the present invention when mounted on a refrigerator.
Figure 16:
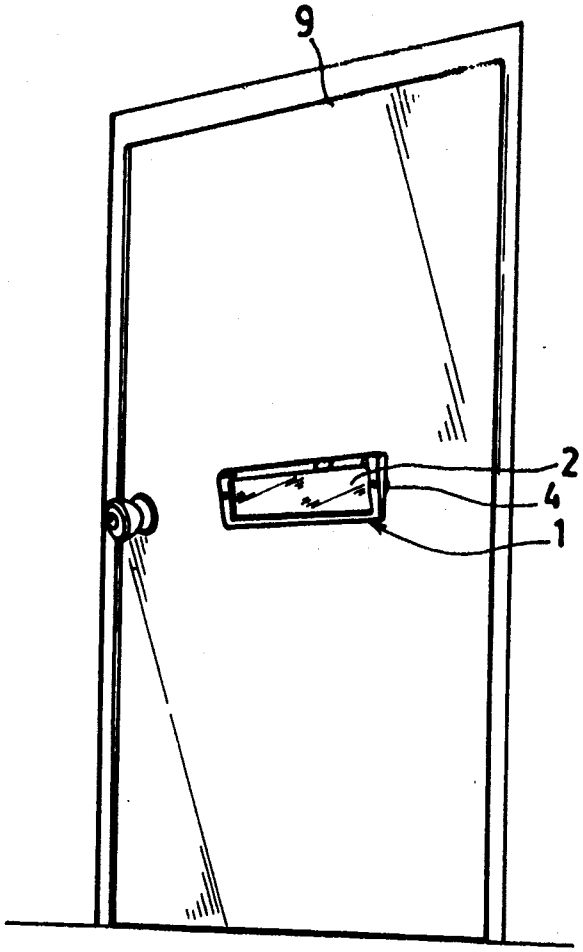
FIG. 16 shows a message display board of the present invention when mounted on a door.
Figure 17:
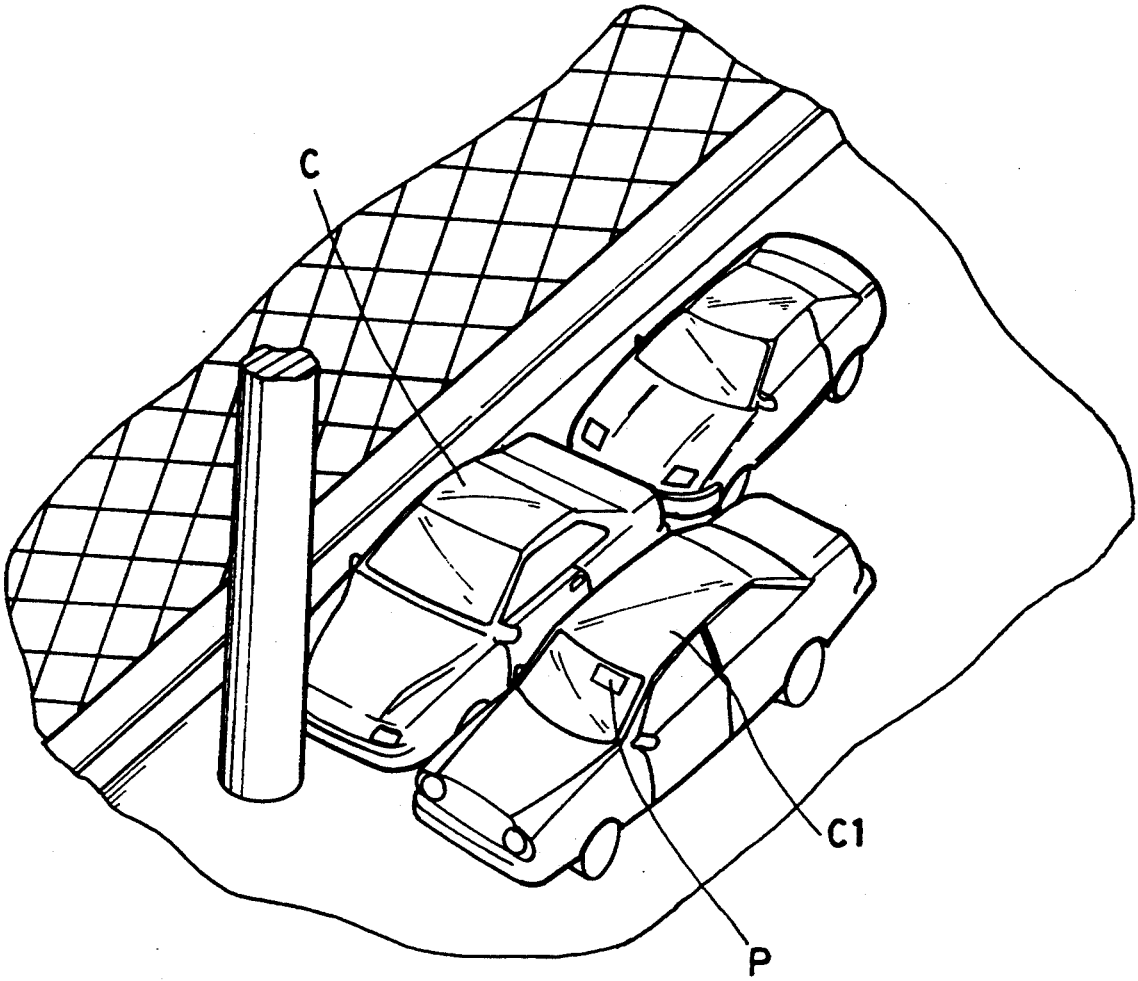
FIG.17 PRIOR ART
FIG. 17 shows a prior art of a conventional message sheet used in a car.

The message display board as shown in FIGS. 10, 11, 12 includes a plurality of first fastening members 4 and second fastening members 5 embedded on a front surface and a rear or back surface of the base plate I for either mounting the message board on a transparent window or on a fixing article 9 such as a refrigerator (FIG. 15) or a door (FIG. 16) for message display or reminder purposes.

The first fastening member 4 may be a suction cup 4 either inserted in a front socket 14 or a rear socket **14*a* as shown in FIG. 12. The second fastening member 5 may be a Velcro tape 5** attached to a coarse surface formed on the fixing article, object or wall.

The present invention is portable, convenient in uses, and can be repeatedly used for giving messages either in day time or night time, without causing environmental contamination since a paper sheet for message use is not required.

I claim:

1. A message display board comprising: a writing board embedded in a base plate mounted on a fixing object, a pen-holding portion formed on the base plate for clamping a pen for writing, a plurality of front fastening members and rear fastening members respectively mounted on a front and a rear surface of the base plate to be secured on a wall to display the writing board outwardly for showing any message written on the writing board, and an illuminating means formed on the base plate for illuminating the writing board to be visible at night time or in dark place; said pen-holding portion including: a groove longitudinally recessed in a rim extension circumferentially disposed around the writing board embedded in the central portion of the base plate for snugly receiving the pen in the groove, a plurality of pairs of pen clips protruding from the base plate for clamping the pen thereon each said pen clip formed with a pair of bending portion bent inwardly for clamping the pen, and a pair of finger recesses each said recess arcuately formed on the base plate continuous to the groove for an easy take-away of the pen by a user's fingers from a pen-holding portion for writing message; and said illuminating means including: a lamp having a first-pole wire and a second-pole wire respectively connected to a first pole and a second pole of a power source containing at least a battery for powering and illuminating the lamp, and an on-off switch resiliently formed on the base plate to be depressed for switching on the power source of the illuminating means for lighting the lamp for illuminating the writing board or to be actuated for switching off the lamp.

2. A message display board according to claim 1, wherein said on-off switch of the illuminating means is a flip-flop switch made of elastomer and operatively depressible to contact the two poles of the power source for lighting the lamp, whereby upon a further depression of said on-off switch to open the two poles of the power source, the lamp will be switched off.

3. A message display board according to claim 1, wherein said lamp of the illuminating means is protruded sidewardly towards the writing board embedded in the base plate through a lamp hole formed in a rim extension circumferentially disposed around the base plate, the lamp hole transversely communicating with a battery chamber recessed in the rim extension for storing the battery of the power source in the battery chamber, the battery chamber vertically connected with a bush protruding upwardly from the rim extension for holding the on-off switch of the illuminating means in the bush, with a maintenance door detachably secured on a side portion of the rim extension for shielding the battery chamber.

4. A message display board according to claim 5, wherein said maintenance door includes a plurality of ventilation openings formed through the door for outwardly dissipating heat produced from the lamp, a pair of tenons formed on two opposite side portions of the door and slidably engageable with a pair of cavities juxtapositionally longitudinally recessed in a door frame formed on the rim extension for slidably engaging the tenons of the maintenance door for allowing said door for shielding the battery chamber.

5. A message display board comprising: a writing board embedded in a base plate mounted on a fixing object, a pen clamped on a pen-holding portion formed on the base plate for writing purpose, a plurality of first fastening members respectively mounted in a front and a rear surface of the base plate and a second fastening member mounted on a rear surface of the base plate for securing the base plate on a wall to display the writing board outwardly for showing message written on the writing board, a lamp secured on the base plate for illuminating the writing board to be visible at night time or in dark place, and an eraser detachably embedded in the base plate and being withdrawn from said base plate for erasing the message written on the board.

6. A message display board according to claim 5, wherein said first fastening member is a suction cup engageably embedded in the base plate.

7. A message display board according to claim 5, wherein said second fastening member is a Velcro tape.

8. A message display board according to claim 5, wherein said eraser includes: an erasing pad secured on a bottom portion of an eraser base, a handle protruding upwardly from the eraser base, the erasing pad and the eraser base slidably engageable in an eraser socket recessed in the base plate and resiliently retained in the eraser socket as urged by a spring member resiliently formed in the eraser socket, and a handle slot formed in the base plate and communicating with the eraser socket and having a width of the slot smaller than a width of the eraser socket, said handle slot slidably engageable with the handle of the eraser so that the eraser may be withdrawn from the eraser socket for erasing the message written on the board and may be reinserted into the eraser socket for storing the eraser in the base plate.

* * * * *